United States Patent [19]

Bisquolm

[11] Patent Number: 4,528,724

[45] Date of Patent: Jul. 16, 1985

[54] CARD CLOTHING FOR THE FLATS OF A CARDING MACHINE

[75] Inventor: Werner Bisquolm, Siebnen, Switzerland

[73] Assignee: Graf & Cie Ag, Rapperswil, Switzerland

[21] Appl. No.: 623,996

[22] Filed: Jun. 25, 1984

[30] Foreign Application Priority Data

Jul. 15, 1983 [CH] Switzerland ..... 3901/83

[51] Int. Cl.[3] ..... D01G 15/24

[52] U.S. Cl. ..... 19/113

[58] Field of Search ..... 19/113, 114, 102, 104, 19/110, 111

[56] References Cited

U.S. PATENT DOCUMENTS

| | | | |
|---|---|---|---|
| 1,709,038 | 4/1929 | Platt | 19/114 |
| 3,936,911 | 2/1976 | Roberts | 19/113 |
| 4,074,392 | 2/1978 | Bechtel | 19/113 |
| 4,221,023 | 9/1980 | Henderson et al. | 19/113 |

FOREIGN PATENT DOCUMENTS

| | | | |
|---|---|---|---|
| 0005884 | of 1890 | United Kingdom | 19/113 |

*Primary Examiner*—Louis K. Rimrodt

*Attorney, Agent, or Firm*—Ladas & Parry

[57] ABSTRACT

The wire sections forming the wire package are arranged on a profile. The individual wire sections are interconnected by means of an adhesive tape adhered to their feet. A T-slot is located in the profile. Accordingly, the adhesive tape contacts at no place the profile. A locking member is located at one end of the profile. This locking member engages by means of protrusions into the slot. The profile comprises an arresting member. The locking member is clamped onto the arresting member. A recess at the end of the locking member facing the wire package allows an impeccable abutting of the locking member on the wires. The wires comprise smooth, toothless end sections having surface areas extending obliquely inwards. This allows the clips, by means of which the card clothing is clamped onto the flats, to safely grip around the ends of the wires and the locking member to hold them clampingly against the profile.

4 Claims, 7 Drawing Figures

CARD CLOTHING FOR THE FLATS OF A CARDING MACHINE

BACKGROUND OF THE INVENTION

1. Field of the Invention

The present invention relates to a card clothing for the flats of a carding machine and including a plurality of wires provided each with a row of teeth and a foot, including further an elongated supporting member supporting the plurality of wires threaded thereupon, and including at least one locking member lockingly holding the plurality of wires in a prestressed state against each other.

Carding machines comprise generally a rotating cylindrical drum and flats which move adjacently and along of a section of the circumference of the drum. The flats move thereby in the direction of the rotation of the drum at a linear speed, which is much smaller than the circumferential speed of the drum, which itself rotates at a relatively high speed. A metal wire comprising teeth is wound tightly around the drum and forms the clothing thereof. Generally, two basic designs of the flats of carding machines are known. One design comprises a supporting member produced from a relatively soft material provided with a multitude of hooks set into the supporting member. The other design comprises a plurality of cast iron flats carrying a plurality of wire sections including teeth. These wire sections are of a design similar to the wire wound around the drum. The teeth of the metal wires wound around the drum and mounted on the flats disentangle, clean and parallelize the fibres located therebetween, shape these fibres to a fleece, which thereafter is condensed into a card sliver.

2. Description of the Prior Art

A large variety of designs of card clothing, consisting of cast iron flats having wire sections located thereupon, are known in the art. The German patent application DE-OS No. 2 145 459 discloses a design of a card clothing in which the wire sections are mounted by means of weldings or adhesive agents to their supporting members, which in turn are mounted to the flats. Such a welding and gluing entails a considerable expenditure of time and accordingly high manufacturing costs.

SUMMARY OF THE INVENTION

It is, therefore, a general object of the present invention to provide an improved card clothing for the flats of a carding machine, which is economical to manufacture, reliable in operation and dependable in use.

A further object is to provide a card clothing for the flats of a carding machine and including a plurality of wires provided each with a row of teeth and a foot, including further an elongated supporting member supporting the plurality of wires threaded thereupon, and including at least one locking member lockingly holding said plurality of wires in a prestressed state against each other, in which the supporting member comprises an elongated profile provided with side plates extending longitudinally thereof, provided further with a longitudinally extending T-slot and at least one arresting member located at one end of the profile; each wire provided at both ends with a smooth, toothless section; which at least one locking member is wedged onto the end of the profile which is provided with the arresting member and in a state of abutting the directly adjacently located wire and of exerting a pressure thereagainst, which locking member has a foot section engaging the longitudinal T-slot, and having at both its sides a projecting protrusion; which side plates of the supporting member abut the face surfaces of the end sections of the wires as well as the face surfaces of the projecting protrusions of the locking member.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF A PREFERRED EMBODIMENT

Figures 1, 2, 3, 4, 5, 6, 7:
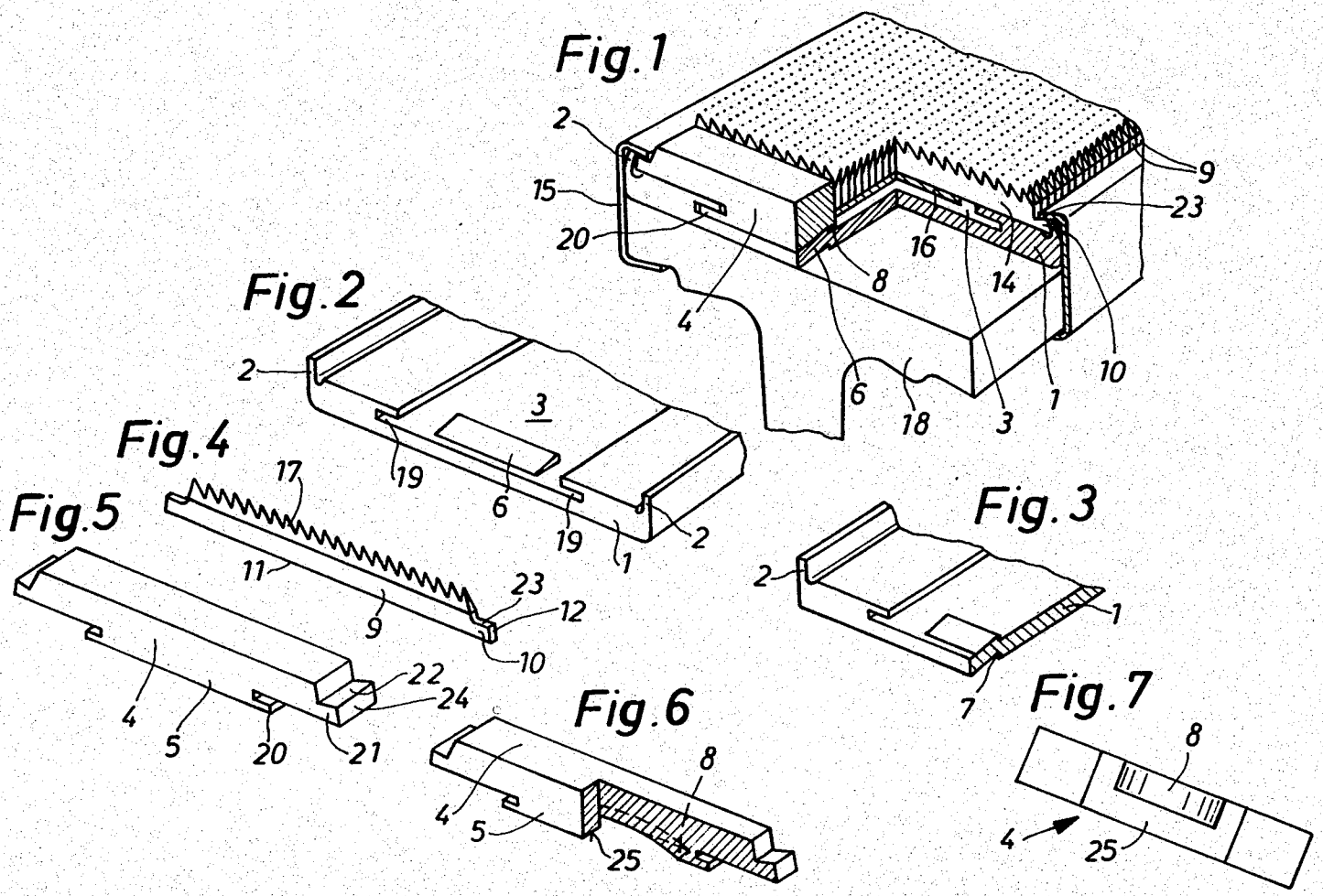
FIG. 1 is a perspective view designed partially in section of a preferred embodiment of the invention.
FIG. 2 is a view of an end section of the supporting member.
FIG. 3 is the end section of FIG. 2, shown partly in section.
FIG. 4 is a toothed wire.
FIG. 5 is a locking member.
FIG. 6 is the locking member of FIG. 5, designed partially in section.
FIG. 7 is a view from below onto the bottom of the locking member of FIG. 5.

Referring now to FIG. 1, there is illustrated a support identified by the reference numeral 1. This support is a profile of an extruded or cold rolled aluminum or aluminum alloy, respectively. Such as clearly shown in FIG. 2 this profile 1 is bordered at both longitudinal sides by a side plate 2. A T-slot extends along the centre area of the profile 1. Accordingly, the profile 1 comprises also two longitudinally extending grooves 19. The illustrated end of the profile 1 comprises a wedge-shaped arresting member 6. Such as shown in FIG. 3 this arresting member 6 is produced by means of an indentation 7 made at the back of the profile 1.

FIG. 4 illustrates the wires 9, the carding wires. They comprise a row of teeth 17 and a foot 11, as a common design of such carding wires. Both ends of the wire 9 are provided with a smooth, toothless end section 10. Each toothless end section 10 comprises an end face 12 and a surface section 23 facing in the direction of the teeth 17 and extending obliquely towards the teeth 17. Accordingly, this obliquely extending surface section 23 extends obliquely relative to the lower edge of the respective foot 11.

FIG. 5 illustrates a locking member 4. This locking member 4 comprises a foot 5 having protrusions 20, projecting at both sides thereof. Such as illustrated in FIG. 1, the locking member 4 is slid into the T-slot 3, and specifically its protrusions 20 engage into the grooves 19. The locking member 4 comprises at both its sides a protrusion 21 having an end face 24 including an obliquely extending surface section 22. The end face 24 of the locking member 4 is aligned with the respective end faces 12 of every wire 9, and the obliquely extending surface section 22 of the locking member 4 is aligned with the respective obliquely extending surface section 23 of the wire 9. Conclusively, the smooth toothless section 10 of the wires 9 has a cross-sectional shape, which is similar to the cross-sectional shape of the respective protrusion 21 of the locking member 4.

Obviously, the locking member 4 must on the one hand abut impeccably the wire 9 located directly adjacently thereto in order to be in a position to exert a pressure onto the wire package 14 and, on the other hand the locking member 4 must be safely locked at the end of the respective profile 1. To this end attention is drawn to FIG. 6. A recess 8, for instance a milled slot is formed in the area of the foot 5 of the locking member 4. This recess 8 extends, however, not along the total thickness of the locking member 4 (measured in longitudinal direction of the profile 1) such as illustrated in FIGS. 6 and 7. Accordingly, this locking member 4 comprises the milled recess 8 and additionally a plane surface 25.

The individual wires 9, which form together the wire package 14, are located on an adhesive tape 16 (see FIG. 1), which adhesive tape 16 adheres to the foot 11 of the respective wires 9. The width of this adhesive tape 16 is smaller than the width of the T-shaped groove 3, and the thickness of this adhesive tape 16 is smaller than the depth of the groove 3. Accordingly, the adhesive tape 16 contacts at no place the profile 1.

The wire sections 9 are, therefore, initially held together by the adhesive tape 16, which allows a more convenient placing of the complete wire package 14 onto the profile 1.

In assembling, the wire sections 9 held together by means of the adhesive tape are placed onto the profile 1. Thereafter, the locking member 4 is threaded into the groove 3 and urged against the wire package 14. During this operation, the arresting member 6 will initially be located within the recess 8 and at a continued urging of the locking member 4 its plane bottom surface 25.

will move onto the wedge-like projecting arresting member 6, such that the locking member 4 will be clamped and clampingly held by the wedge-shaped arresting member 6.

The opposite end of the profile 1, which is not specifically shown in the drawings, can be provided with a rigid stop member against which the wire package 14 is pressed by means of the locking member 4 or, according to an alternative embodiment, the mentioned opposite end of the profile 1 can comprise a further wedge-shaped arresting member 6, and in such case a second locking member 4 will be wedged on at the mentioned opposite end of the profile 1.

This card clothing will, thereafter, be placed onto the known cast iron flat 18 and mounted thereto by means of the similarly known clips 15. It is now to be noted that such as is clearly shown in FIG. 1, the side plates 2 are bent towards the end faces 12 of the individual wire sections 9, and against the end faces 24 of the locking member 4, such that these structural elements are held by a clamping action thereagainst. The height of the side plates 2 is somewhat less than the height of the end faces 12 and 24. This allows the clips 15 to lie safely and impeccably on the obliquely extending surface sections 23 of the wire sections 9 as well as the obliquely extending surface sections 22 of the locking member 4. Also, the profile member made from cold rolled or extruded aluminum or aluminum alloy is protected at its sides by the clips 15 against any damage.

While there is shown and described the present preferred embodiment of the invention, it is to be distinctly understood that the invention is not limited thereto, but may be otherwise variously embodied and practiced within the scope of the following claims.

I claim:

1. A card clothing for the flats of a carding machine and including a plurality of wires provided each with a row of teeth and a foot, including further an elongated supporting member supporting said plurality of wires threaded thereupon, and including at least one locking member lockingly holding said plurality of wires in a prestressed state against each other, said supporting member comprising an elongated profile provided with side plates extending longitudinally thereof, provided further with a longitudinally extending T-slot and at least one arresting member located at one end of the profile; each said wire provided at both its ends with a smooth, toothless section; which said at least one locking member is wedged onto the end of said profile which is provided with said arresting member and in a state of abutting the directly adjacently located wire and of exerting a pressure thereagainst, said locking member having a foot section engaging said longitudinal T-slot and having at both its sides a projecting protrusion; said side plates of said supporting member abutting the face surfaces of said smooth end sections of said wires as well as the face surfaces of the projecting protrusion of said locking member.

2. The card clothing of claim 1, wherein said wires forming a wire package are arranged on an adhesive tape adhering to the respective foot sections, the width of said tape being smaller than the width of said T-slot and the thickness of said tape being smaller than the depth of said T-slot.

3. The card clothing of claim 1, in which said smooth toothless end sections of each said wires comprise a surface section facing in the direction of the teeth and extending obliquely thereagainst, said protrusions of said at least one locking member comprising a further surface section extending aligned relative to said wire surface sections, which surface sections and which further surface sections are intended to be clampingly enveloped by the clips mounting the card clothing to the respective flat of a carding machine.

4. The card clothing of claim 1, wherein said arresting member is a wedge-shaped protrusion projecting from the bottom of said T-slot and wherein said foot section of said locking member is provided with a recess open towards the wire package and closed towards the face end of said supporting member.

* * * * *